US005158403A

United States Patent [19]

Moors

[11] Patent Number: 5,158,403

[45] Date of Patent: Oct. 27, 1992

[54] MATERIAL HANDLING ARRANGEMENT

[76] Inventor: H. William Moors, P. O. Box 381, Dawson Springs, Ky. 42408

[21] Appl. No.: 746,754

[22] Filed: Aug. 19, 1991

Related U.S. Application Data

[63] Continuation of Ser. No. 556,178, Jul. 23, 1990, abandoned.

[51] Int. Cl.[5] ..... B65D 19/16

[52] U.S. Cl. ..... 108/56.3; 108/51.1

[58] Field of Search ..... 108/51.1, 52.1, 56.3, 108/57.1; 206/598, 600

[56] References Cited

U.S. PATENT DOCUMENTS 3,227,107 1/1966 Caplan ..... 108/51.1

FOREIGN PATENT DOCUMENTS 2528779 12/1983 France ..... 108/51.1

1032178 6/1966 United Kingdom .

*Primary Examiner*—Gerald A. Anderson

*Attorney, Agent, or Firm*—Warren D. Flackbert

[57] ABSTRACT

A material handling arrangement basically in the form of a knockdown pallet which serves ease in pallet return to a point of origin for reuse purposes. The arrangement is presented in various forms, each reflecting adaptability to use and including a variety of approaches for maintaining component interaction and assembly.

4 Claims, 2 Drawing Sheets

35
10f
10d
10c
3
3
2
2
10b
10
35
10a
10f
10g
10f
10e
10a
10e
10f 10f
10g
10e'
10c
10f
10b
10e'

21
22c
22d 5
5
21a
6
22b
6
21b
22a
20
24
21a
35
21a
25c 21b
22d
24
22c
21b
35

25b
22b

MATERIAL HANDLING ARRANGEMENT

The present application is a continuation of application Ser. No. 556,178, filed Jul. 23, 1990 with the same inventor now abandon.

As is known, the transporting of material, such as parts and/or components needed for production, the finalized product and/or the like, usually require sturdy, and oftentimes quite cumbersome and/or heavy, shipping pallets and/or containers. A basic problem with the current shipping procedures, however, lies in pallet return, since destruction after shipment (use) would be costly and unjustifiable and, as well, the expense involved for pallet return to the point of origin is likewise uneconomical.

A need has arisen, therefore, for providing a pallet or like material handling arrangement which is readily and positively assembled for contents receipt prior to shipment and which, thereafter, and after contents removal, may be disassembled, i.e. knocked down, so that the pallet may be returned to the point of origin (until physical replacement becomes necessary).

BRIEF DESCRIPTION OF THE INVENTION

The invention accomplishes the preceding in a variety of arrangements, each primarily affording ready assembly at the site of reuse and, as well, ready disassembly at the point of shipment unloading. The common denominator of each of the procedures lies in the use inexpensive releasable metal ribbon for fastening ease, or inexpensive threaded elements for the same purpose. In other words, the means of positive assembly must be convenient and inexpensive since such are the only components which will probably be replaced during reassembly.

In any event, the significance of the invention is apparent in the instance of large sized pallet type units which serve item support purposes and, at the same time, as a means for securing coverment. Thus, a large area coverage would make invention usage advantageous, considering that a relatively small number of disassembled components would replace a large expanse of assembled components.

BRIEF DESCRIPTION OF THE FIGURES

A better understanding of the present invention will become more apparent from the following description, taken in conjunction with the accompanying drawings, wherein FIG. 1 is a perspective view showing one form of material handling arrangement in accordance with the teachings of the present invention;

Figures 2, 3, 4, 5, 6:
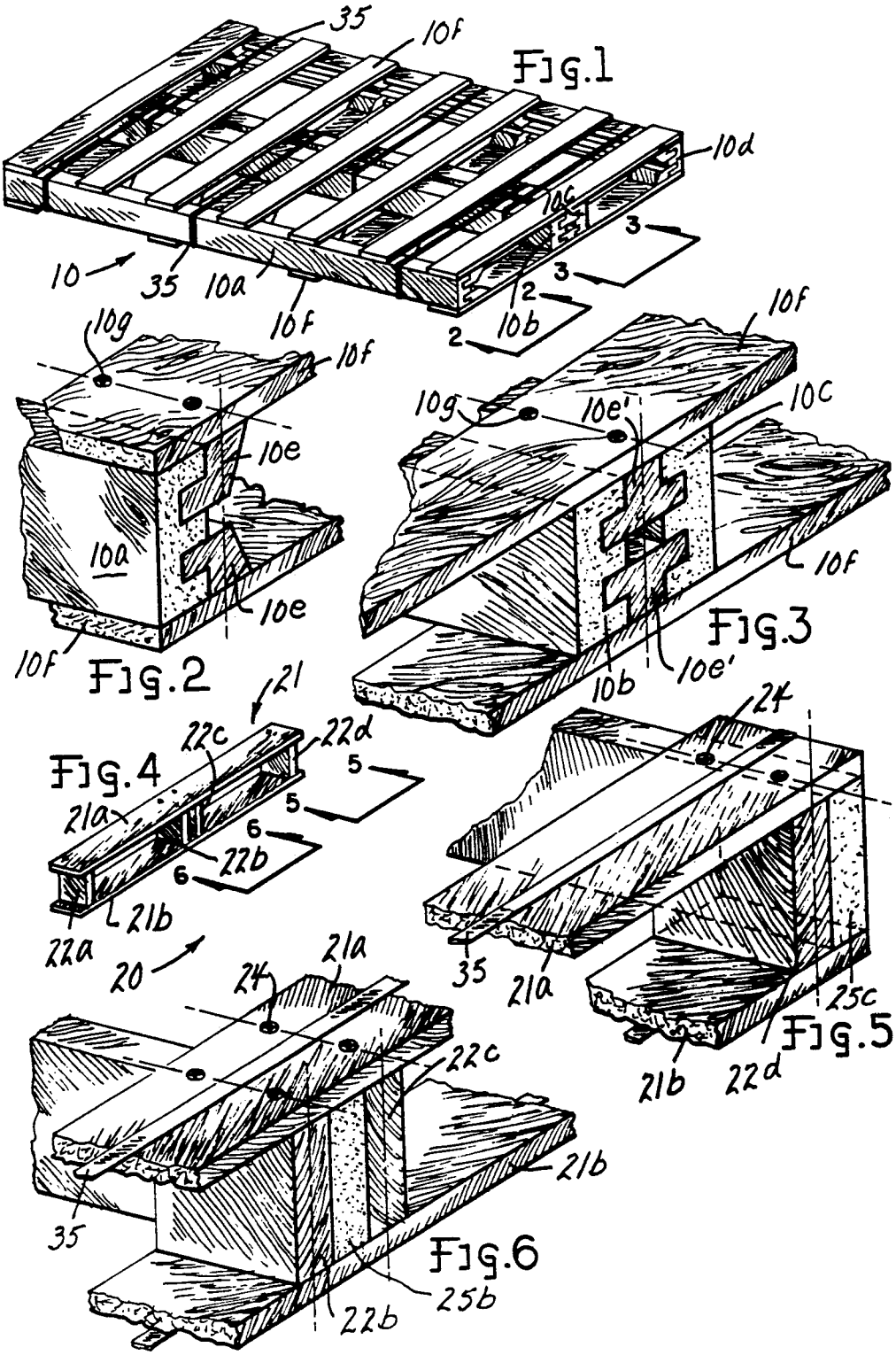
FIG. 2 is a perspective view detailing the invention form of FIG. 1, taken at line 2—2 on such figure and looking in the direction of the arrows.
FIG. 3 is another perspective view, further detailing the invention, in this instance taken at line 3—3 on FIG. 1 and looking in the direction of the arrows.
FIG. 4 is a perspective view of a component forming part of another material handling arrangement in accordance with the teachings of the present invention.
FIG. 5 is a perspective view detailing the invention form of FIG. 4, taken at line 5—5 on such figure and looking in the direction of the arrows.
FIG. 6 is another perspective view detailing the invention form of FIG. 4, in this instance, however, taken at line 6—6 on such figure and looking in the direction of the arrow.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

DESCRIPTION OF THE EMBODIMENTS

Referring now to FIGS. 1, 2 and 3, one form 10 of material handling arrangement is disclosed, where such, typically, presents a carrying expanse or area suitable for large material/equipment. Basically, the unit 10 is defined by longitudinally disposed spacers 10*a*, 10*b*, 10*c* and 10*d*, where spacers 10*a* and 10*d* define edges of the unit 10 and spacers 10*b*, 10*c*, facing each other, are in the mid-area of the unit 10.

The spacers 10*a*, 10*b*, 10*c* and 10*d* selectively receive locking members 10*e*, 10*e*', i.e. as respectively shown in one form in FIG. 2 and in another form in FIG. 3. The locking numbers 10*e*, 10*e*' are each secured to upper and lower lateral members 10*f*, as through threaded means 10*g* (see FIGS. 2 and 3).

The outer surfaces of upper and lower lateral members 10*f* collectively serves as a receiving area, where each of such also serve to locate one of the longitudinal spacers 10*a*, 10*b*, 10*c* and 10*d*.

In other words, a positive assembly is achieved through interaction of locking members 10*e*, 10*e*' and spacers 10*a*, 10*b*, 10*c* and 10*d*, and, ultimately, the use of flexible and releasable metal banding 35 around selected spacers 10*a*, 10*b*, 10*c* and 10*d*, with associated fasteners (not shown), to maintain the unit 10 in an assembled condition, notwithstanding the overall area thereof.

It shall be understood that upon disassembly, a large area of material handling structure is combined into a relatively small and compact bundle of transportable components, representing ease in shipping, as well as a significant decrease in cost.

Referring now to FIGS. 4, 5 and 6, another material handling arrangement 20 is disclosed, where, in this instance, the principal feature thereof is the use of a series of laterally disposed support members 21, each defined by upper and lower members 21*a*, 21*b* spaced apart by upstanding locating members 22*a*, 22*b*, 22*c* and 22*d* (see FIG. 4).

As evident in such figure, and typically, upstanding locating members 22*a* and 22*d* are spaced inwardly from the outer edges of the upper and lower members 21*a*, 21*b*, while upstanding locating members 22*b* and 22*c* are spaced apart, but maintained in the general lateral mid-area of the unit 20. As particularly evident in FIGS. 4, 5 and 6, the upstanding locating members 22*a*, 22*b*, 22*c*, and 22*d* are secured into position through the use of screw members 24.

In use, the finished material handling unit 20 may assume various dimensions, depending upon stock length. In assembly, a series of support members 21 are placed in a spaced apart side-by-side relationship, where, thereafter, longitudinal members 25*a* (not shown) and 25*c* are received in the spacing at the free ends of the upper and lower members 21*a*, 21*b* and within (longitudinal member 25*b*) the spacing between the centrally disposed upstanding locating members 22*b*, 22*c*. Flexible releasible banding 35 is employed to maintain the assembly in a unitary condition, including the use of fasteners (not shown).

As in the instance of material handling arrangement 10, disassembly of material handling arrangement 20 is readily accomplished, permitting the compacting of the support members 21 and all longitudinal members 25*a*, 25*b* and 25*c* for economies in returning the handler 20 to its point of origin.

Figure 7:
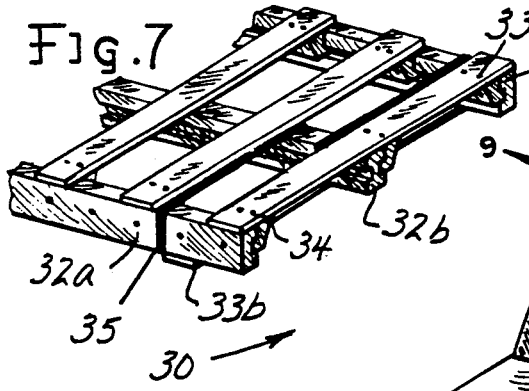
FIG. 7 is a perspective view showing a still further form of the material handling arrangement in accordance with the teachings of the present invention.
Figure 9:
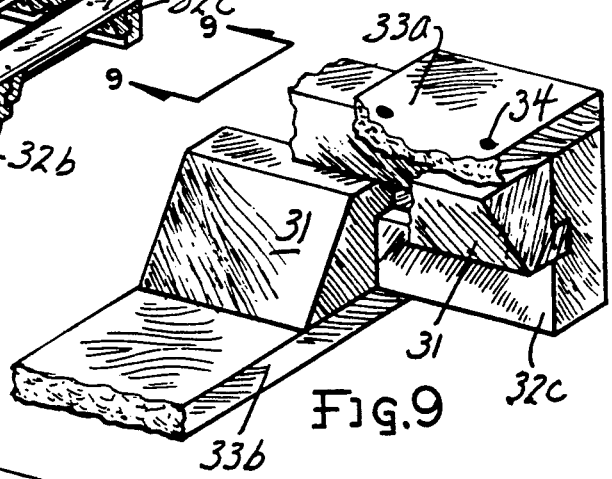
FIG. 9 is perspective view detailing the invention form of FIG. 7, taken at line 9—9 on such figure and looking in the direction of the arrows; and, FIG. 10 is a view in elevation detailing an assembly arrangement in accordance with the teachings of the present invention.
Figure 8:
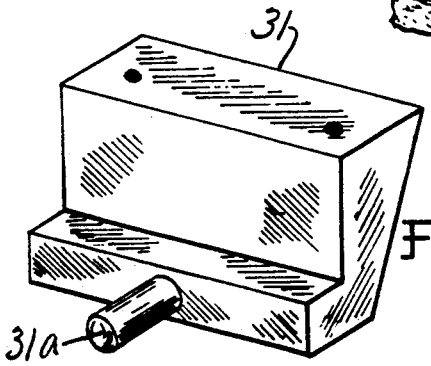
FIG. 8 is a perspective view of a component of the invention form of FIG. 7.

FIGS. 7, 8 and 9 disclose a further form of material handling arrangement 30 in accordance with the invention. In this instance, locking is achieved through the use of an independent fasteners 31 (see FIGS. 8 and 9), typically molded from a plastic resin.

As evident in FIG. 7, and somewhat in FIG. 9, longitudinal members 32*a*, 32*c* each include a longitudinal cut-out area, while, in the instance of horizontal member 32*b* and at the mid-region, two cut-out areas. Threaded means 34, together with a pin 31*a*, serve to position each fastener 31 at a use location typically illustrated in FIG. 7.

In other words, a similar relationship is evident with invention embodiment 30, i.e. one similar to that of embodiments 10 and 20. In this instance, however, fasteners 31, each having a particular configuration, are secured to one of a series of lateral receiving members 33*a* and 33*b* (certain of which may be side-by-side - see FIG. 9) selectively engaged in a locking relationship with the aforesaid longitudinal cut-out in longitudinal members 32*a*, 32*b* and 32*c*. Flexible releasable banding 35 is also employed.

Again, and upon disassembly, only a small bundle of operative components remain, meaning ease of shipment to the point of origin and, as well, handling economies.

Figure 10:
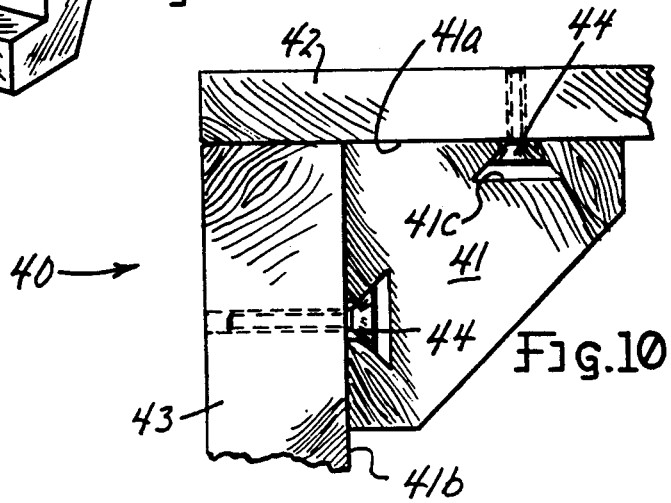

FIG. 10 is included to show another means of assembly/disassembly 40. In this instance, a longitudinal web-like member 41 having a surfaces 41*a* engaging the inner surface of a top pallet member 42 and a surface 41*b* engaging the inner surface of side pallet member 43 includes channel or longitudinal cut-outs 41*c* for receiving (and retaining) the flattened heads of recessed screws 44.

In other words, and with the aid of a mallet (not shown), the wedge-like member 41 can be driven so that the heads of screws 44 are retained in the channel-like cut-outs 41*c* provided along the length thereof. In other words, FIG. 10 represents further significance in achieving a knockdown pallet assembly/disassembly arrangement for ready reuse purposes.

As should be evident, therefore, the invention overcomes a significant problem in the transporting of items requiring large area expanse, i.e. in permitting the ready disassembly of such at the point of destination and reuse at the point of origin. The preceding forecloses ungainly empty pallet reshipment for a reuse operation. Thus, the invention sparks interest not only in a knockdown pallet per se, but, also, various forms of such to accommodate particular shipping problems.

The material handling arrangement of the invention, in several presented forms, is susceptible to various changes within the spirit of the invention, including, by way of example, in proportioning; the precise independent locking means employed and the location of such; the manner of securement of the releasable banding, the latter being a common ingredient in the art; and, the like. Thus, the preceding should be considered illustrative and not as limiting the scope of the following claims:

I claim:

1. A pallet including a series of spaced-apart lateral members presenting upper and lower pallet surfaces, first locating members in opposed outer ends of said lateral members and pairs of second locating members in a region between said first locating members, longitudinal members abutting the sides of said first and second locating members along said outer ends of said lateral members and along said region, and first releasable banding encircling said longitudinal members proximate one of said outer ends of said lateral members and proximate said region and second releasable banding proximate the other of said outer ends of said lateral members and proximate said region, where said lateral members and said locating members present a series of modules spaced-apart long the longitudinal extend of said pallet.

2. A pallet including a series of spaced-apart lateral members presenting upper and lower pallet surfaces, first locating members in opposed spaced-apart relationship recessed from each of the outer ends of said lateral members and pairs of second locating members in a region between said first locating members, longitudinal members abutting the sides of said first and second locating members along said outer ends of said lateral members and along said region, and first releasable banding encircling said longitudinal members proximate one of said outer ends of said lateral members and proximate said region and second releasable banding proximate the other of said outer ends of said lateral members and proximate said region, where said pallet is recylcable solely upon release of said banding and subsequent reassembly.

3. A pallet including a series of spaced-apart lateral members presenting upper and lower pallet surfaces, first locating members in opposed spaced-apart relationship recessed from each of the outer ends of said lateral members and second locating members in a region between the outer ends, longitudinal members abutting the sides of said locating members along said outer ends of said lateral members and abutting a locating member in said region, and first releasable banding encircling said longitudinal members proximate one of said outer ends of said lateral members and proximate said region and second releasable banding proximate the other of said outer ends of said lateral members and proximate said region, where said lateral members and said locating members present a series of modules spaced-apart along the longitudinal extend of said pallet.

4. A pallet including a series of spaced-apart lateral members presenting upper and lower pallet surfaces, first locating members in opposed spaced-apart relationship recessed from each of the outer ends of said lateral members and at least one second locating member in a region between said outer ends, longitudinal members abutting said locating member along said outer ends of said lateral members and abutting said second locating member in said region, and first releasable banding encircling said longitudinal members proximate one of said outer ends of said lateral members and proximate said region and second releasable banding proximate the other of said outer ends of said lateral members and proximate said region, where said pallet is recyclable solely upon release of said banding and subsequent reassembly.

* * * * *